US007055478B2

(12) United States Patent
Christgen et al.

(10) Patent No.: US 7,055,478 B2
(45) Date of Patent: Jun. 6, 2006

(54) INTERMEDIATE LEVER FOR A VARIABLE VALVE TRAIN OF AN INTERNAL COMBUSTION ENGINE

(75) Inventors: Wolfgang Christgen, Seukendorf (DE); Harald Smola, Langenzenn (DE); Klaus Bonaventura, Hamburg (DE); Horst Döppling, Herzogenaurach (DE)

(73) Assignee: Ina-Schaeffler KG (DE)

( * ) Notice: Subject to any disclaimer, the term of this patent is extended or adjusted under 35 U.S.C. 154(b) by 0 days.

(21) Appl. No.: 11/156,824

(22) Filed: Jun. 20, 2005

(65) Prior Publication Data

US 2005/0241601 A1 Nov. 3, 2005

Related U.S. Application Data

(63) Continuation of application No. PCT/EP2003/014299, filed on Dec. 16, 2003.

(30) Foreign Application Priority Data

Dec. 21, 2002 (DE) ..... 102 60 557

(51) Int. Cl.
*F01L 1/34* (2006.01)

(52) U.S. Cl. ..... 123/90.16; 123/90.15; 123/90.31

(58) Field of Classification Search ..... 123/90.15, 123/90.16, 90.31
See application file for complete search history.

(56) References Cited

U.S. PATENT DOCUMENTS 6,612,277 B1 * 9/2003 Genise ..... 123/90.45
2002/0162522 A1 11/2002 Morrn

FOREIGN PATENT DOCUMENTS

| | | | |
|---|---|---|---|
| DE | 43 26 331 | A1 | 2/1995 |
| DE | 19708484 | A1 | 9/1998 |
| DE | 198 17 849 | A1 | 10/1998 |
| DE | 197 21 210 | A1 | 11/1998 |
| DE | 199 13 742 | A1 | 9/2000 |
| DE | 100 17 441 | A1 | 10/2001 |
| DE | 100 59 545 | A1 | 6/2002 |
| DE | 101 23 186 | A1 | 11/2002 |
| DE | 10125 082 | A1 | 11/2002 |
| EP | 0 638 706 | A1 | 2/1995 |
| EP | 0 780 547 | A1 | 6/1997 |
| EP | 1 039 103 | A2 | 9/2000 |
| EP | 1 143 118 | A2 | 10/2001 |
| EP | 1 255 027 | A 1 | 11/2002 |

* cited by examiner

*Primary Examiner*—Thomas Denion
*Assistant Examiner*—Zelalem Eshete
(74) *Attorney, Agent, or Firm*—Charles A. Muserlian

(57) ABSTRACT

The invention proposes an intermediate lever (1) for a variable valve train of an internal combustion engine, said intermediate lever (1) comprising a loading end (2) and a pivoting end (3), a cam contacting surface (4) and a support (5) for a resetting spring (6), the loading end (2) extending on a front end of the intermediate lever (1) and comprising a sliding surface (7) for making contact with a lever-type valve opener, the pivoting end (3) being designed so as to cooperate with eccentric means for affecting a change of position of the intermediate lever (1), and the cam contacting surface (4) being arranged between the loading end (2) and the pivoting end (3), wherein the intermediate lever (1) is made of a thin-walled sheet metal and is manufactured substantially by a punching plus bending method and wherein the support (5) is arranged on an upper side (8, 9) of the intermediate lever (1) in an edge region (10) adjoining the loading end (2) and has a convex portion extending towards the upper side (8, 9) for contact by a leg (11) of a torsion spring constituting the resetting spring (6), said support (5) being laterally delimited by two guide tabs (12, 13).

10 Claims, 2 Drawing Sheets

INTERMEDIATE LEVER FOR A VARIABLE VALVE TRAIN OF AN INTERNAL COMBUSTION ENGINE

This application is a continuation of PCT application EP2003/014299 filed Dec. 16, 2003.

FIELD OF THE INVENTION

The invention concerns an intermediate lever for a variable valve train of an internal combustion engine, said intermediate lever comprising a loading end and a pivoting end, a cam contacting surface and a support for a resetting spring, the loading end extending on a front end of the intermediate lever and comprising a sliding surface for making contact with a lever-type valve opener, the pivoting end being designed so as to cooperate with eccentric means for affecting a change of position of the intermediate lever, and the cam contacting surface being arranged between the loading end and the pivoting end.

BACKGROUND OF THE INVENTION

An intermediate lever of a generic type is disclosed in EP 0 638 706 A1. This lever has a number of inherent drawbacks. For the one thing, it is made by a casting method. This has a negative effect on the costs of manufacture and on the mass. It is further noted that the resetting spring is a coiled spring that acts in a rather complex manner in the crosswise direction and is fixed with one end on a plate. This coiled spring unnecessarily increases the design space requirement in the transverse direction of the cylinder head. Under certain circumstances, when the design space on or in the cylinder head is very restricted, it can become extremely difficult to accommodate the coiled spring. It is finally remarked that the aforesaid intermediate lever, due to the fact that it is only clamped between the components: cams of the camshaft, eccentric, resetting spring and lever-type valve opener, has no adequate guidance, for example, in the lateral direction.

OBJECTS OF THE INVENTION

It is an object of the invention to provide an intermediate lever of the pre-cited type in which the aforesaid drawbacks are eliminated with simple measures.

This and other objects and advantages of the invention will become obvious from the following detailed description.

SUMMARY OF THE INVENTION

The invention achieves the above objects by the fact that the intermediate lever is made of a thin-walled sheet metal and is manufactured substantially by a punching plus bending method. In a first, particularly preferred embodiment of the invention, the support is arranged on one of an upper side or an underside of the intermediate lever in an edge region adjoining the loading end and has a convex portion extending towards said one of the upper side or the underside for contact by a leg of a torsion spring constituting the resetting spring, said support being laterally delimited by two guide tabs.

In this way, the initially described drawbacks are effectively eliminated. On the one hand, due to the fact of being made of sheet metal, the intermediate lever is comparatively light. On the other hand, a person skilled in the art recognizes that, postulating an adequate rigidity and load-bearing ability of the component, the proposed fabrication out of sheet metal is clearly cheaper than fabrication by a casting method.

The support for the resetting spring, preferably configured as a torsion leg spring, is intended to support one leg of said spring and has a convex shape in the length direction of the intermediate lever while being preferably made integrally in one piece with the loading end of the intermediate lever.

The guide tabs proposed by the invention for delimiting the support offer an excellent guidance for the intermediate lever in its clamped state in the valve train. Due to the convex shape of the support, in addition, an edge contact of the respective leg of the torsion spring during a pivoting motion of the intermediate lever is avoided.

Further propositions of the invention concern advantageous embodiments of the guide tabs. In one embodiment, these guide tabs extend out of a front end of the support and are bent back in the shape of horns onto the support. In a further embodiment, the guide tabs are configured in the form of extensions projecting vertically from the upper side or underside of the intermediate lever.

According to an advantageous development of the last-mentioned embodiment, the support may be fixed in depressions of the guide tabs. With this configuration, an undesired warping of the support due to loading is effectively avoided.

In still another embodiment, the guide tabs are formed out of lateral surfaces of the support. For this purpose, the support must comprise a wing-like extension on each side, and these extensions must then be bent toward each other. In this case, it is possible to omit the additional fixing measures stated below. However, this embodiment is not illustrated in the drawing.

If necessary, it is possible, in this and in the first embodiment, to secure the guide tabs additionally to the support, for example, by a weld joint.

The aforesaid depressions can be made, for example, immediately after punching out the contour of the intermediate lever, for instance by embossing. It is, however, also conceivable to make the depressions by a slight stamping or by machining.

If, as additionally proposed, the cam contacting surface is preferably made as a rolling-bearing mounted roller, frictional work is additionally minimized in this region.

The scope of protection of the present invention is herewith explicitly stated to cover solutions in which the features and embodiments discussed above are implemented even if the intermediate lever is not made of a sheet metal and/or is not fabricated by a punching plus bending method.

The invention will now be described more closely with reference to the appended drawing.

DETAILED DESCRIPTION OF THE DRAWING

Figure 2:
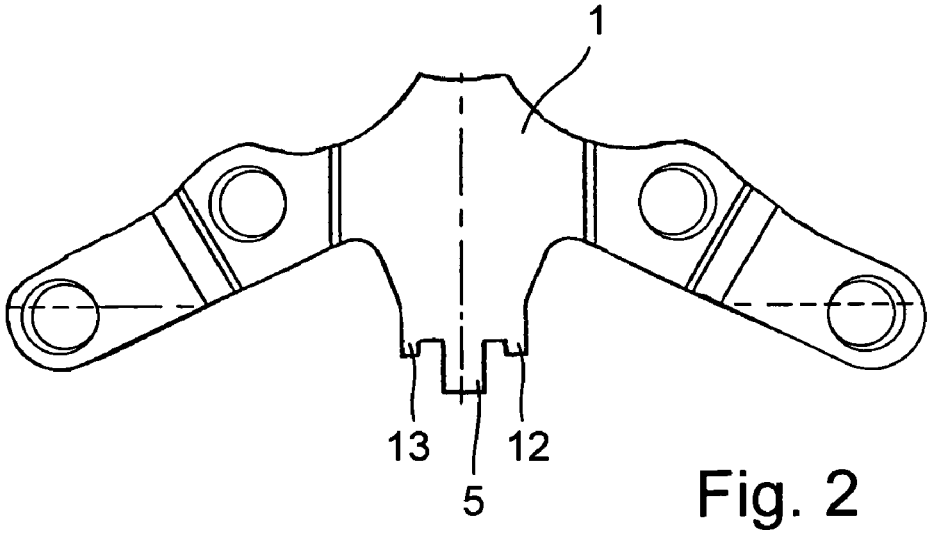
FIG. 2 shows the intermediate lever as a punched blank prior to bending.
Figure 3:
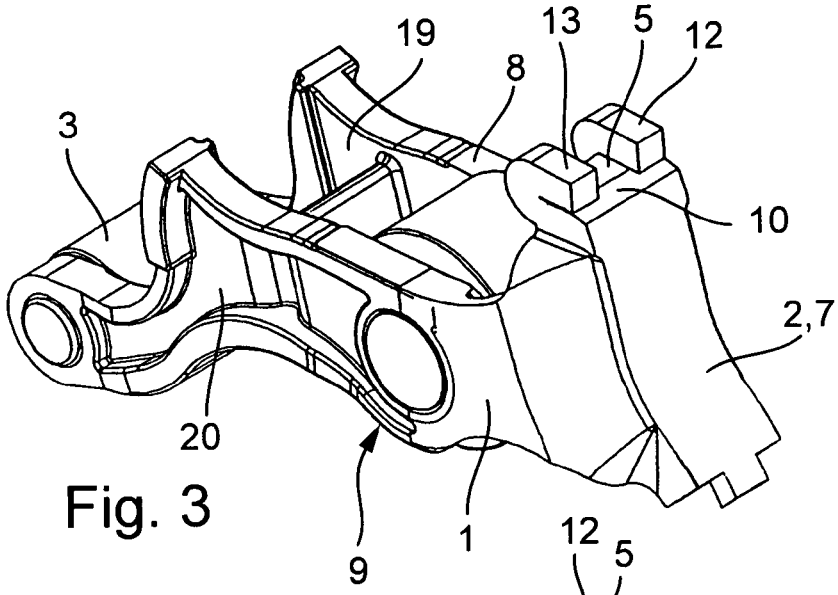
FIG. 3 is a three-dimensional view of the intermediate lever comprising a support and guide tabs of the invention.
Figure 4:
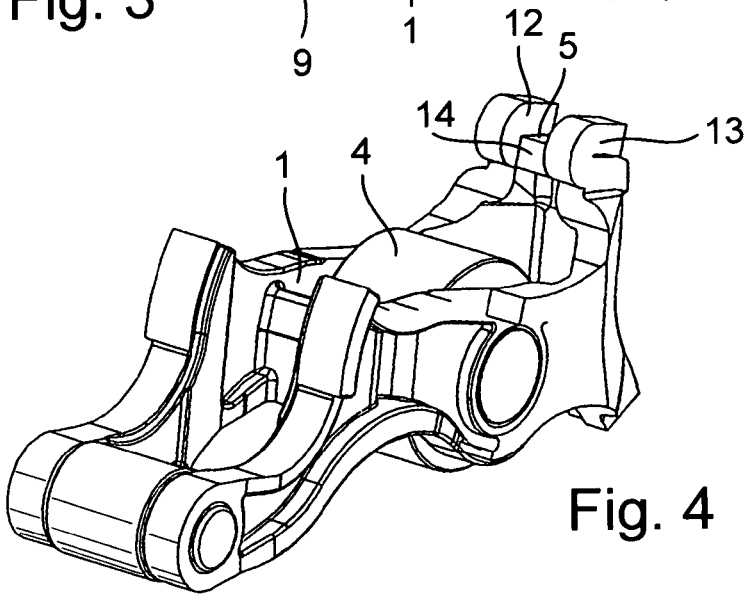
FIG. 4 is a three-dimensional view of the intermediate lever comprising a support and guide tabs of the invention.
Figure 5:
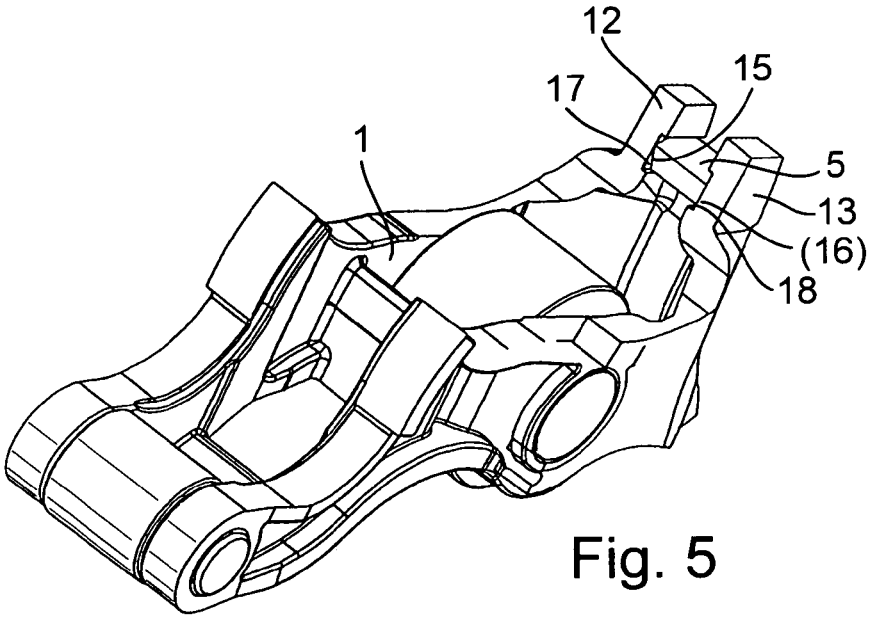
FIG. 5 is a three-dimensional view of the intermediate lever comprising a support and guide tabs of the invention.

The intermediate lever 1 of the invention is made out of thin-walled sheet metal (sheet steel) and is fabricated by a punching plus bending method. FIG. 2 shows the punched blank out of which the intermediate lever 1 is made. By bending over the wing-like extensions on each side of the line of symmetry while retaining a base surface for forming a loading end 2 with a sliding surface 7, an intermediate lever 1 having substantially the final configuration shown in FIGS. 3 to 5 is obtained. Prior to the aforesaid bending step, however, the support identified at "5" must be brought into an approximately orthogonal position with respect to the blank, so that, upon bending, this support 5 is already situated between the guide tabs 12, 13 thus formed (design of FIG. 5).

The intermediate lever 1 generally comprises two parallel side walls 19, 20 as also a loading and a pivoting end 2, 3. In the present embodiment, the loading end 2 is arranged on a front end of the intermediate lever 1 and is configured over its entire length as a sliding surface 7 for contact with a lever-type valve opener such as an oscillating lever or a finger lever. The pivoting end 3, in contrast, is configured with a rotating roller for engagement in or by one or more eccentric means for changing the position of the intermediate lever 1 (BMW Valvetronic design).

Between the loading end 2 and the pivoting end 3, the lever comprises a cam contacting surface 4 configured in the present example as a rotating roller.

Figure 1:
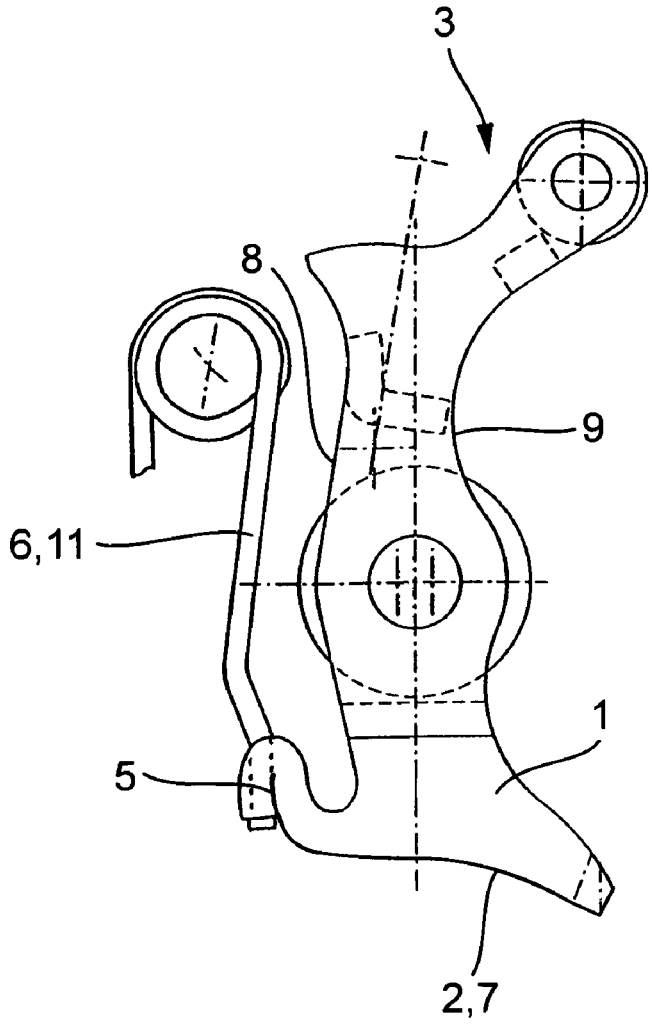
FIG. 1 is a side view of an intermediate lever of the invention comprising a resetting spring in the form of a torsion leg spring.

A permanent cam contact of the intermediate lever 1 is assured by a resetting spring 6 (see FIG. 1) that is configured in the present case as a torsion spring whose one leg 11 bears against the support 5. The use of a torsion spring offers many advantages, for example also with regard to design space, as already discussed above.

As mentioned above, the intermediate lever 1 is made of a thin-walled sheet metal by a punching plus bending method. This enables, without the use of separate components, the creation of the support 5 for the leg 11 of the resetting spring 6 and the lateral guide tabs 12, 13. Due to the fact that the support 5 preferably has a convex shape, no edge contact with undesired wear etc. takes place during a pivoting motion of the intermediate lever 1. As can be seen in FIGS. 3 to 5, the support 5 is made as an extension of the loading end 2 and is bent toward the upper side 8.

As disclosed in FIGS. 3 and 4, each guide tab 12, 13 is made from a strip-like extension that extends from a front end 14 of the support 5 and is bent over in the shape of a horn onto the support 5 toward the loading end 2.

In an alternative embodiment according to FIG. 5, each guide tab 12, 13 is made as a portion extending away from the upper side 8. In the present case, the guide tabs extend approximately orthogonally away from the upper side 8. It can be additionally seen that depressions 17, 18 are generated on inner sides of the guide tabs 12, 13, for example by embossing. The support 5 is retained in these depressions 17, 18 through its respective sides 15, 16. In this way, any warping of the support 5 during operation of the intermediate lever 1 is prevented.

An additional retention can be created through an additional welding or the like in the transition region from the guide tabs 12, 13 to the support 5.

All in all, the intermediate lever 1 provided by the invention dispenses with the cast structure hitherto used in the prior art, and thus possesses advantages of mass. At the same time, by using sheet metal, manufacturing costs can be reduced. Moreover, due to the fact that the support 5 together with delimiting guide tabs 12, 13 is made integrally in one piece with the intermediate lever 1, an excellent support is created for the leg 11 of the resetting spring 6 and an additional guidance is provided for the intermediate lever 1 in its "clamped-in" state in the variable, preferably fully variable, valve train.

The invention claimed is:

1. An intermediate lever for a variable valve train of an internal combustion engine, said intermediate lever comprising a loading end and a pivoting end, a cam contacting surface and a support for a resetting spring, the loading end extending on a front end of the intermediate lever and comprising a sliding surface for making contact with a lever-type valve opener, the pivoting end being designed so as to cooperate with eccentric means for effecting a change of position of the intermediate lever, and the cam contacting surface being arranged between the loading end and the pivoting end, wherein the intermediate lever is made of a thin-walled sheet metal and is manufactured substantially by a punching plus bending method wherein the support is arranged on one of an upper side or an underside of the intermediate lever in an edge region adjoining the loading end and has a convex portion extending towards said one of the upper side or the underside for contact by a leg of a torsion spring constituting the resetting spring, said support being laterally delimited by two guide tabs.

2. An intermediate lever of claim 1, wherein the support together with the guide tabs is made integrally in one piece with the intermediate lever.

3. An intermediate lever of claim 1, wherein the support is configured as an extension of the loading end and is bent towards said one of the upper side or the underside, and each guide tab is made of a strip-like extension in extending direction of the support, said strip-like extension starts from a front end of the support, said strip-like extension in extending preferably towards the loading end.

4. An intermediate lever of claim 1, wherein the support is configured as extension of the loading end and is bent towards said one of the upper side or the underside, and each guide tab is formed by a portion projecting away from said one of the upper side or the lower side.

5. An intermediate lever of claim 4, wherein each guide tab comprises a depression having a shape that is complementary to an opposing side of the support, said opposing side being retained in said depression.

6. An intermediate lever of claim 5, wherein said depression is made by a non-cutting method that is typically one of embossing or slight stamping.

7. An intermediate lever of claim 1, wherein the support is configured as an extension of the loading end and is bent towards said one of the upper side or the underside, and the guide tabs are formed by extensions projecting laterally away from the support, said extensions being bent through approximately 90° towards each other so as to project away from said one of the upper side or the underside.

8. An intermediate lever of claim 1, wherein the cam contacting surface is configured as a rotating roller that is optionally arranged on a rolling bearing.

9. An intermediate lever of claim 3, wherein the support and the guide tabs are fixed to each other through one of a welded joint, a soldered joint or a glued joint.

10. An intermediate lever of claim 4, wherein the support and the guide tabs are fixed to each other through one of a welded joint, a soldered joint or a glued joint.

* * * * *